US012122432B2

(12) United States Patent
Hintermeir

(10) Patent No.: US 12,122,432 B2
(45) Date of Patent: Oct. 22, 2024

(54) SNOW PROTECTION ASSEMBLY FOR A COUPLING REGION OF A RAIL VEHICLE

(71) Applicant: SIEMENS MOBILITY GMBH, Munich (DE)

(72) Inventor: Stefan Hintermeir, Aschau I. Ch (DE)

(73) Assignee: Siemens Mobility GmbH, Munich (DE)

( * ) Notice: Subject to any disclaimer, the term of this patent is extended or adjusted under 35 U.S.C. 154(b) by 855 days.

(21) Appl. No.: 17/285,559

(22) PCT Filed: Oct. 1, 2019

(86) PCT No.: PCT/EP2019/076533
§ 371 (c)(1),
(2) Date: Apr. 15, 2021

(87) PCT Pub. No.: WO2020/078711
PCT Pub. Date: Apr. 23, 2020

(65) Prior Publication Data

US 2022/0063683 A1 Mar. 3, 2022

(30) Foreign Application Priority Data

Oct. 15, 2018 (DE) ..... 10 2018 217 594.2

(51) Int. Cl.
*B61G 7/00* (2006.01)
*B61G 7/10* (2006.01)
*B61G 7/14* (2006.01)

(52) U.S. Cl.
CPC ..... *B61G 7/00* (2013.01); *B61G 7/10* (2013.01); *B61G 7/14* (2013.01)

(58) Field of Classification Search
CPC ... B61G 3/16; B61G 7/00; B61G 7/14; B61D 17/06
See application file for complete search history.

(56) References Cited

U.S. PATENT DOCUMENTS 8,622,003 B2 * 1/2014 Radewagen ..... B61D 17/02 105/238.1
8,757,066 B2 * 6/2014 Heinisch ..... B61D 17/06 105/392.5

(Continued)

FOREIGN PATENT DOCUMENTS

CN 201049637 Y 4/2008
CN 102785675 A 11/2012

(Continued)

*Primary Examiner* — Zachary L Kuhfuss
*Assistant Examiner* — Cheng Lin
(74) *Attorney, Agent, or Firm* — Laurence A. Greenberg; Werner H. Stemer; Ralph E. Locher

(57) ABSTRACT

A snow protection assembly is provided for a coupling region of a rail vehicle. The rail vehicle has, on an end face, a recess which protects against snow, in which recess a coupling of the rail vehicle is arranged. A fixed housing partially extends around the recess. The housing has an opening in the direction of travel of the rail vehicle, from which opening the coupling partially protrudes to enable a process of coupling to an additional rail vehicle. The opening of the fixed housing is peripherally fixedly connected to a first sealing element. A second sealing element is rotatably connected to the coupling, and the second sealing element partially extends around the coupling. The two sealing elements partially overlap in the region of the opening. The two sealing elements are coupled to one another by pressure to protect the opening against the ingress of snow.

13 Claims, 9 Drawing Sheets

(56) References Cited

U.S. PATENT DOCUMENTS

| | | | | |
|---|---|---|---|---|
| 9,440,664 | B2 * | 9/2016 | Liu | B61G 7/14 |
| 9,527,517 | B2 * | 12/2016 | Westman | B61G 7/00 |
| 2012/0291659 | A1 | 11/2012 | Radewagen | |

FOREIGN PATENT DOCUMENTS

| | | | | |
|---|---|---|---|---|
| DE | 102015214606 | A1 * | 2/2017 | B61D 17/06 |
| DE | 102016219267 | A1 | 4/2018 | |
| EP | 2177416 | A1 | 4/2010 | |
| EP | 2308738 | A1 | 4/2011 | |
| EP | 3231685 | A1 * | 10/2017 | B61G 7/00 |
| EP | 3492334 | A1 | 6/2019 | |
| TW | 200940387 | A | 10/2009 | |
| WO | WO-2017215850 | A1 * | 12/2017 | B61G 1/00 |

* cited by examiner

SNOW PROTECTION ASSEMBLY FOR A COUPLING REGION OF A RAIL VEHICLE

BACKGROUND OF THE INVENTION

Field of the Invention

The invention relates to a snow protection arrangement for a coupling region of a rail vehicle which travels in regions with snow.

Depending on the travel direction, speed, snowfall, snow conditions, etcetera, an accumulation or collection of snow on the rail vehicle may occur. A critical region for such accumulations of snow is the region around the coupling at the front side of the rail vehicle. The coupling which is arranged at that location is constructed for coupling additional rail vehicles (for example, for coupling with a traction vehicle of another snow vehicle pairing) and is used accordingly.

Depending on the vehicle overhang, the vehicle length and the bogie spacing, couplings in specific regions must be able to be pivoted horizontally and vertically in order to enable the coupling operation or in order to be able to travel on bends and in points areas.

This results in funnel-like openings around the coupling which are virtually predestined to be filled with snow.

Under extreme conditions, this filling with snow leads to the coupling no longer being able to move. This may result in critical operating limitations and in rare cases even lead to safety-relevant limitations during operation of the rail vehicle.

FIG. 5 and FIG. 6 each show a rail vehicle SFZ6, SF27 with couplings KUP6, KUP7 and with coupling regions KUPB6, KUPB7 which are completely covered in snow or ice.

It may be assumed that these rail vehicles SFZ6, SFZ7 are no longer suitable for use.

Embodiments with which this ice or snow problem in the coupling region is overcome are known.

FIG. 7 shows a first embodiment in an American locomotive as a rail vehicle SFZ8.

This vehicle is configured in the coupling region KUPB8 in such a manner that the associated coupling KUP8 is constructed to be very short. In addition, pivot angles of the coupling KUP8 required by the concept are minimized. Decisive features for such a vehicle concept are the parameters length, bogie spacing and vehicle overhang of the rail vehicle SFZ8. If these parameters are selected in a favorable manner, the coupling KUP8 can be produced with a small length and with small pivot angles in a horizontal and vertical direction.

FIG. 8 shows a second embodiment in a German Intercity ICE as a rail vehicle SFZ9.

The rail vehicle SFZ9 is configured in the coupling region KUPB9 with a short coupling (concealed in this instance) and with a small front opening FROE9. This embodiment is complex since a construction with front flaps FKL9 is required in order to reduce or completely prevent the penetration of snow in the coupling region KUPB9. This embodiment is used particularly in high-speed trains since in this instance the front flap construction affords advantages with respect to the snow and additionally with regard to the aerodynamics.

FIG. 9 shows a third embodiment in a traction unit or rail vehicle SFZ10 of a German suburban railway. The rail vehicle SFZ 10 has in the coupling region KUPB10 a manually removable snow protection system which is constructed in this instance as a covering hood AH10. The covering hood AH10 is placed over the coupling KUP10 and then covers it at least partially. Such a covering hood AH10 is, for example, produced from a strong, that is to say, mechanically durable, tarpaulin, as also used in the truck sector for covering cargo.

Such a snow protection system is very cost-effective but requires for assembly or for disassembly time and manual work from operators during the coupling operation.

In addition, such a snow protection measure does not always prevent the penetration of snow into the pivot region of the coupling.

FIG. 10 and FIG. 11 show details of a coupling situation in an additional rail vehicle SFZ11.

In this instance, FIG. 10 shows in detail a coupling region KUPB11 which can be filled with snow and which can consequently become clogged. It is further possible to see a coupling joint KUPG11 which is arranged in the coupling region KUPB11 and which cooperates with the coupling KUP11 from FIG. 11.

Accordingly, a coupling KUP11 and the coupling joint KUPG11 are shown in FIG. 11.

SUMMARY OF THE INVENTION

An object of the present invention is to provide an advantageous snow protection arrangement for coupling regions of a rail vehicle.

This object is achieved by the features of the independent claim.

Advantageous developments are set out in the dependent claims.

The invention relates to a snow protection arrangement for a coupling region of a rail vehicle.

The rail vehicle has at a front side a recess which is intended to be protected from snow and in which a coupling of the rail vehicle is at least partially arranged. A fixed housing at least partially surrounds the recess. The housing has in the travel direction of the rail vehicle an opening from which the coupling partially protrudes in a predetermined angular position in order to enable a coupling operation with an additional rail vehicle. The opening of the fixed housing is securely connected peripherally to a first sealing element. A second sealing element is rotatably connected to the coupling and the second sealing element at least partially surrounds the coupling. The two sealing elements at least partially overlap each other in the region of the opening in different angular positions of the coupling. The two sealing elements are coupled to each other by means of pressure in order to protect the opening and consequently the recess from penetration of snow.

The coupling is constructed in such a manner that the rail vehicle can be connected via the coupling to a correspondingly configured coupling of an additional rail vehicle.

The coupling is preferably movably supported inside the recess so that, for the purposes of the coupling operation or for the purposes of travelling on bends and in points areas with the additional rail vehicle, the coupling can be horizontally and vertically pivoted in a predetermined angular range.

Therefore, the coupling has for the coupling operation and during operation of the connected rail vehicles corresponding angular positions.

The recess is at least partially surrounded by a fixed housing. The coupling is protected in the region of the recess by means of the fixed housing.

The opening of the fixed housing is securely connected peripherally to a sealing element, the first sealing element, so that via the connection the sealing element is also fixed or rigid.

The first sealing element has a snow-tight transition to the housing.

The first sealing element is preferably produced from a flexible rubber as a sealing element of the housing.

The sealing element of the housing is preferably configured as a hollow chamber profile or as a bead.

The coupling is connected to a second sealing element which at least partially surrounds the coupling.

The second sealing element has a snow-tight transition to the coupling.

The second sealing element is rotatably connected to the coupling as a sealing element of the coupling, wherein this connection is preferably configured as a swivel joint.

The rotatability of the second sealing element and the positions and shapes of the two sealing elements causes, in different angular positions of the coupling, the sealing element of the coupling always to be coupled to the sealing element of the housing as a result of the action of pressure.

The second sealing element is preferably configured as a hollow chamber profile or as a bead.

The two sealing elements at least partially overlap each other and movably abut each other. As a result of their respective positions, the two sealing elements are pressed onto each other.

Preferably, a frictional engagement is produced between the two sealing elements.

The second sealing element is preferably produced from a flexible rubber.

As a result of the hollow chambers or beads, an additional flexibility of the sealing elements is produced and the desired frictional engagement is supported.

In a preferred development, the second sealing element has flexible sleeves which are arranged in the region around the coupling and which additionally seal this region.

These flexible sleeves are preferably produced from rubber.

As a result of the two sealing elements, a sealing of the opening against snow is achieved and functions in a reliable manner with each movement of the coupling.

Translational movements of the coupled rail vehicle are absorbed in the direction of the longitudinal axis of the rail vehicles by the hollow chamber profiles or the beads being pressed in with simultaneous sealing.

In the case of lateral movements transversely relative to the longitudinal axis, the hollow chamber profiles or beads slide on each other and consequently absorb these movements with simultaneous sealing.

During angular movements (rolling, yawing, swaying) of the connected rail vehicles relative to each other, the hollow chamber profiles or beads are pressed in to differing degrees. All relative movements which occur are thereby absorbed with simultaneous sealing.

The arrangement according to the invention can be both produced and retrofitted in a cost-effective manner and with little complexity.

As a result of the arrangement according to the invention, it is ensured that the operational readiness of rail vehicles in severe winter months is increased without requiring manual interventions.

Coupling times of rail vehicles which were previously required in the event of snowfall and which result from the manual work of railway operators are reduced.

As a result of the arrangement according to the invention, downtimes of rail vehicles which are brought about by couplings blocked by snow are reduced.

The present invention is explained in greater detail below by way of example with reference to drawings.

DETAILED DESCRIPTION OF THE INVENTION

Figure 1:
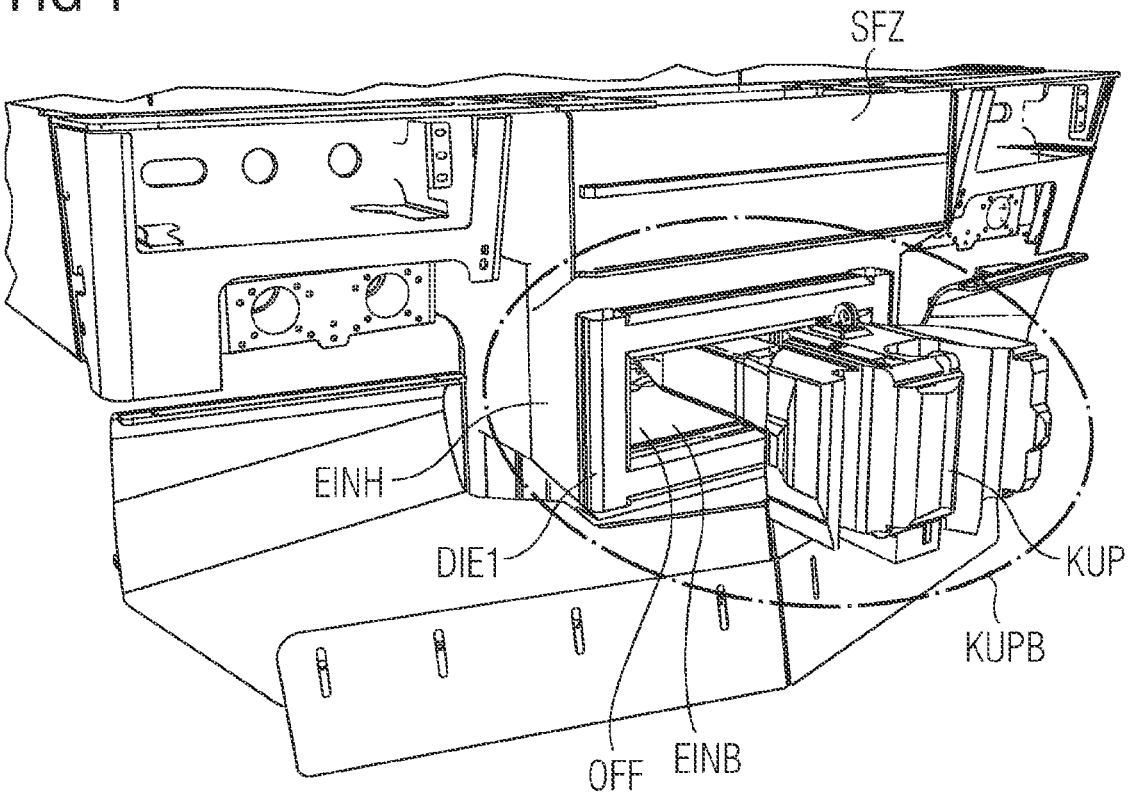
FIG. 1 is a first detailed view of the arrangement according to the invention.

FIG. 1 is a first detailed view of the arrangement according to the invention. A coupling region KUPB of a rail vehicle SFZ is illustrated.

The rail vehicle SFZ has at the front side thereof a recess EINB which is intended to be protected from snow and in which a coupling KUP of the rail vehicle SFZ is at least partially arranged.

A fixed housing EINH at least partially surrounds the recess EINB. The housing EINH has in the travel direction of the rail vehicle SFZ an opening OFF from which the coupling KUP partially protrudes in a predetermined angular position in order to enable a coupling operation with an additional rail vehicle.

The opening OFF of the fixed housing EINH is securely connected peripherally to a first sealing element DIE1.

In this example, the first sealing element DIE1 is configured as a flexible hollow chamber profile.

The size of the opening (DOFF is sized in such a manner that the coupling KUP can carry out all movements which result from operation.

The housing EINH is securely connected to the front of the rail vehicle SFZ and cannot move with respect to the rail vehicle.

The opening OFF together with the peripheral sealing element DIE1 is also sized in such a manner that the coupling KUP can carry out all necessary movements during operation.

Figure 2:
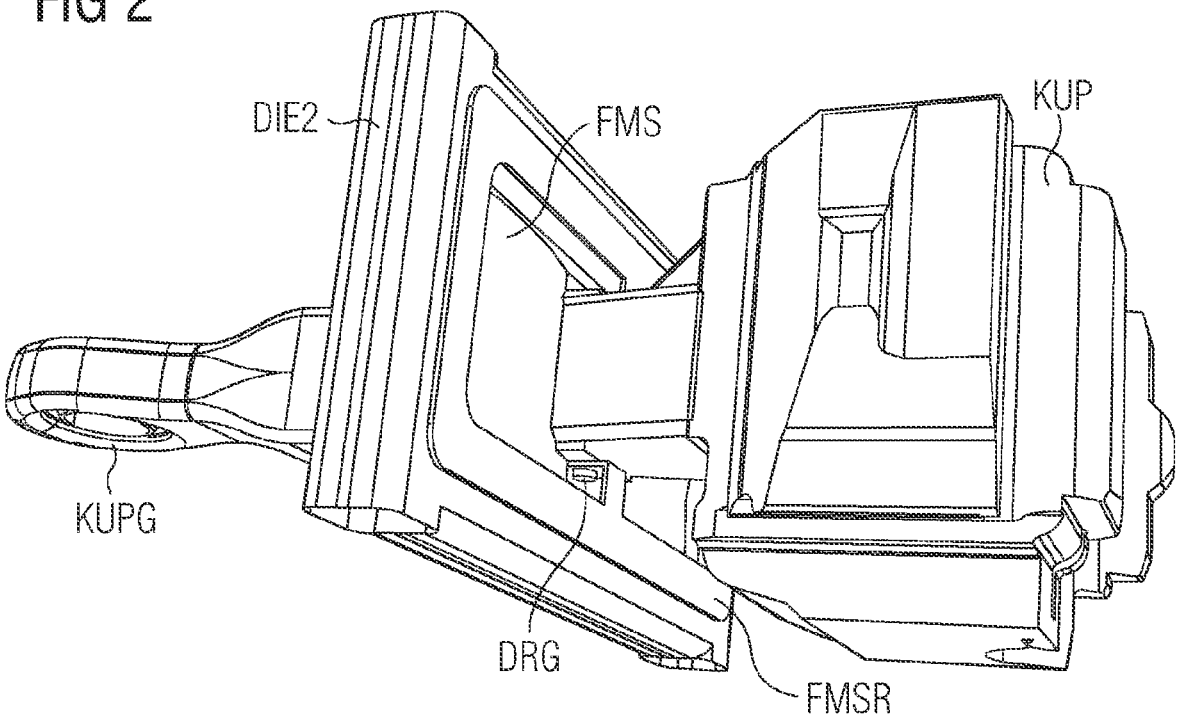
FIG. 2 is a second detailed view of the arrangement according to the invention.

FIG. 2 shows with partial reference to FIG. 1 a second detailed view of the arrangement according to the invention.

A second sealing element DIE2 is rotatably connected to the coupling KUP. The second sealing element DIE2 at least partially surrounds the coupling KUP.

In this example, the second sealing element DIE2 is configured as a flexible hollow chamber profile.

The second sealing element DIE2 is connected to the coupling KUP by means of a swivel joint DRG.

In addition, the second sealing element DIE2 has flexible sleeves FMS which are arranged in the region around the coupling KUP and which additionally seal the transition to the coupling KUP.

The flexible sleeves FMS have peripherally a frame FMSR via which they are connected to the hollow chamber profile.

Figure 10:
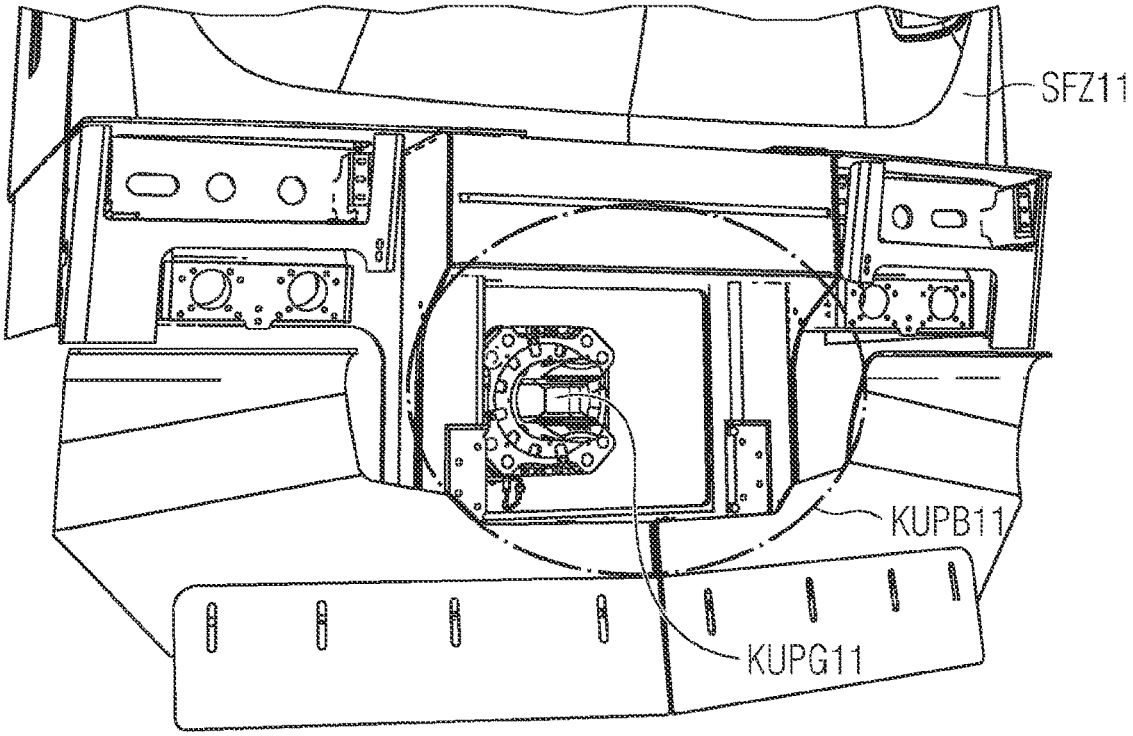
Figure 11:
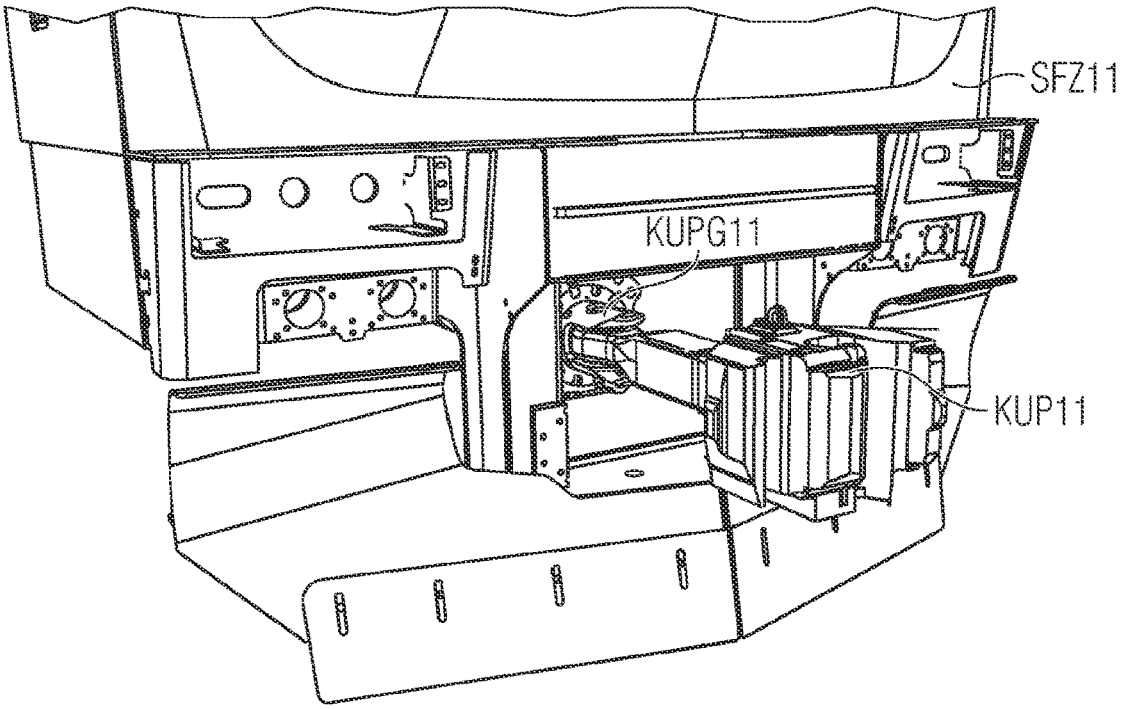

It is also possible to see a coupling joint KUPG, via which the coupling KUP is secured in the recess EINB of the rail vehicle SFZ by means of a joint. Via this joint (cf. also in this regard the coupling joint KUPG11 of FIG. 10), it is possible for the coupling KUP to assume different angular positions in order to carry out the coupling operation and during the travel of connected rail vehicles.

The rotatably movable second sealing element DIE2 results in it repeatedly being orientated toward the first sealing element DIE1 when the coupling KUP is rotated about a vertical axis.

Figure 3:
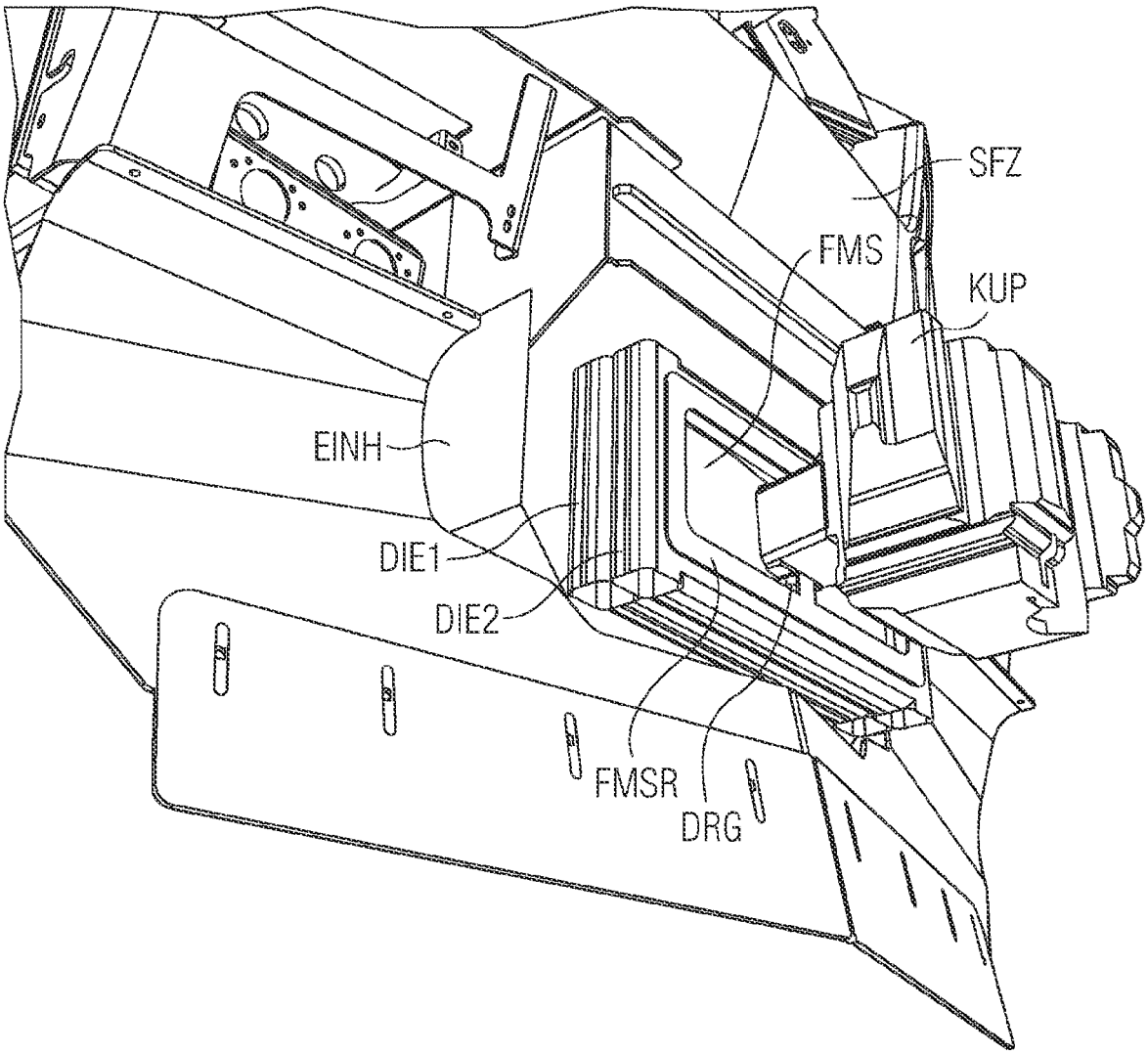
FIG. 3 is a complete view of the arrangement according to the invention.

FIG. 3 shows with reference to FIG. 1 and FIG. 2 a complete view of the arrangement according to the invention.

The two sealing elements DIE1, DIE2 at least partially overlap each other in the region of the opening OFF at different angular positions of the coupling KUP. The two sealing elements DIE1, DIE2 are coupled to each other by means of pressure and thereby protect the opening OFF from penetration of snow.

The rotatably movable second sealing element DIE2 results in it always being orientated toward the first sealing element DIE1 when the coupling KUP is rotated about a vertical axis, wherein the capacity for sealing is maintained at the same time.

Figure 4:
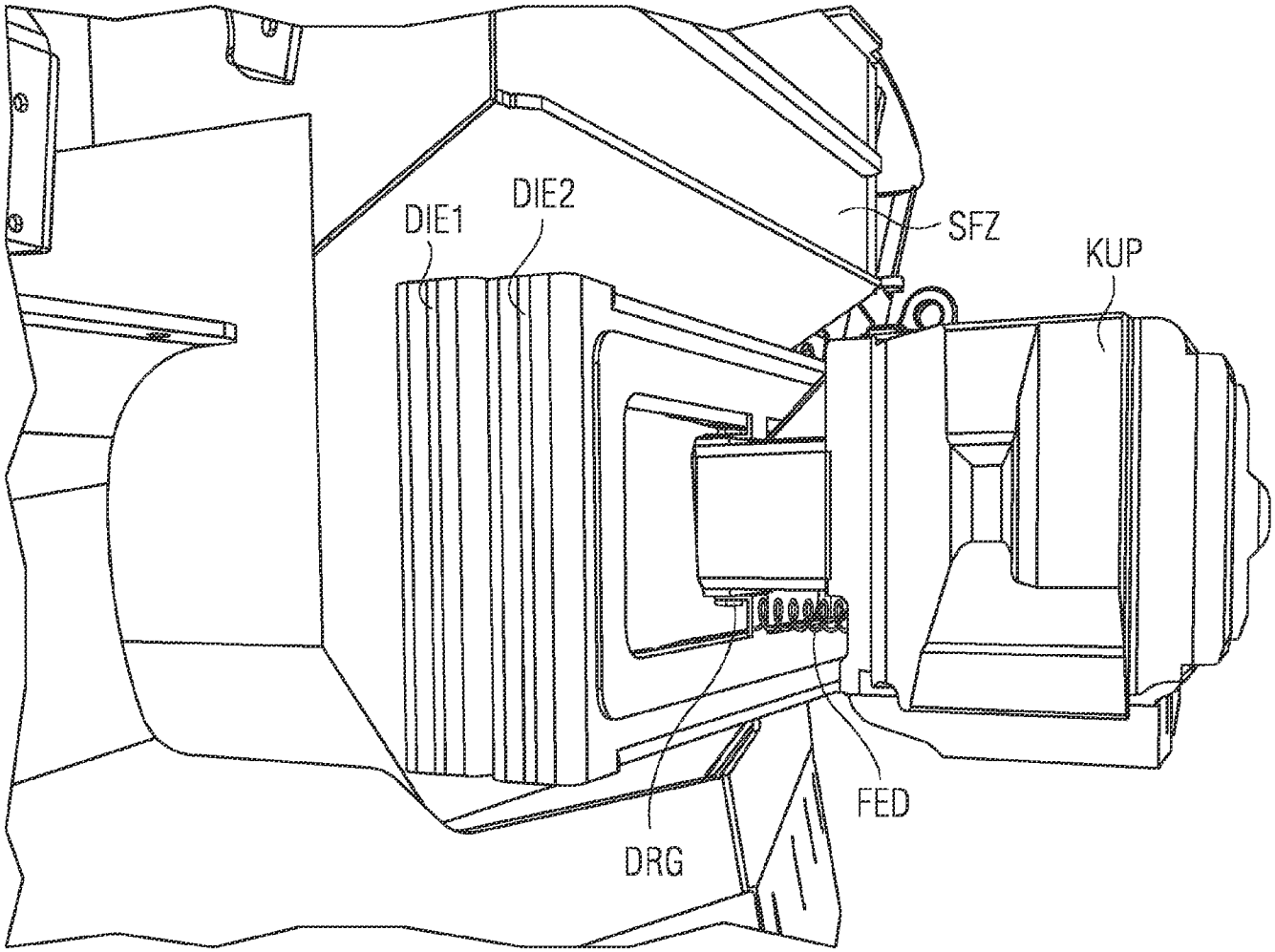
FIG. 4 is an advantageous development of the arrangement according to the invention.
Figure 5:
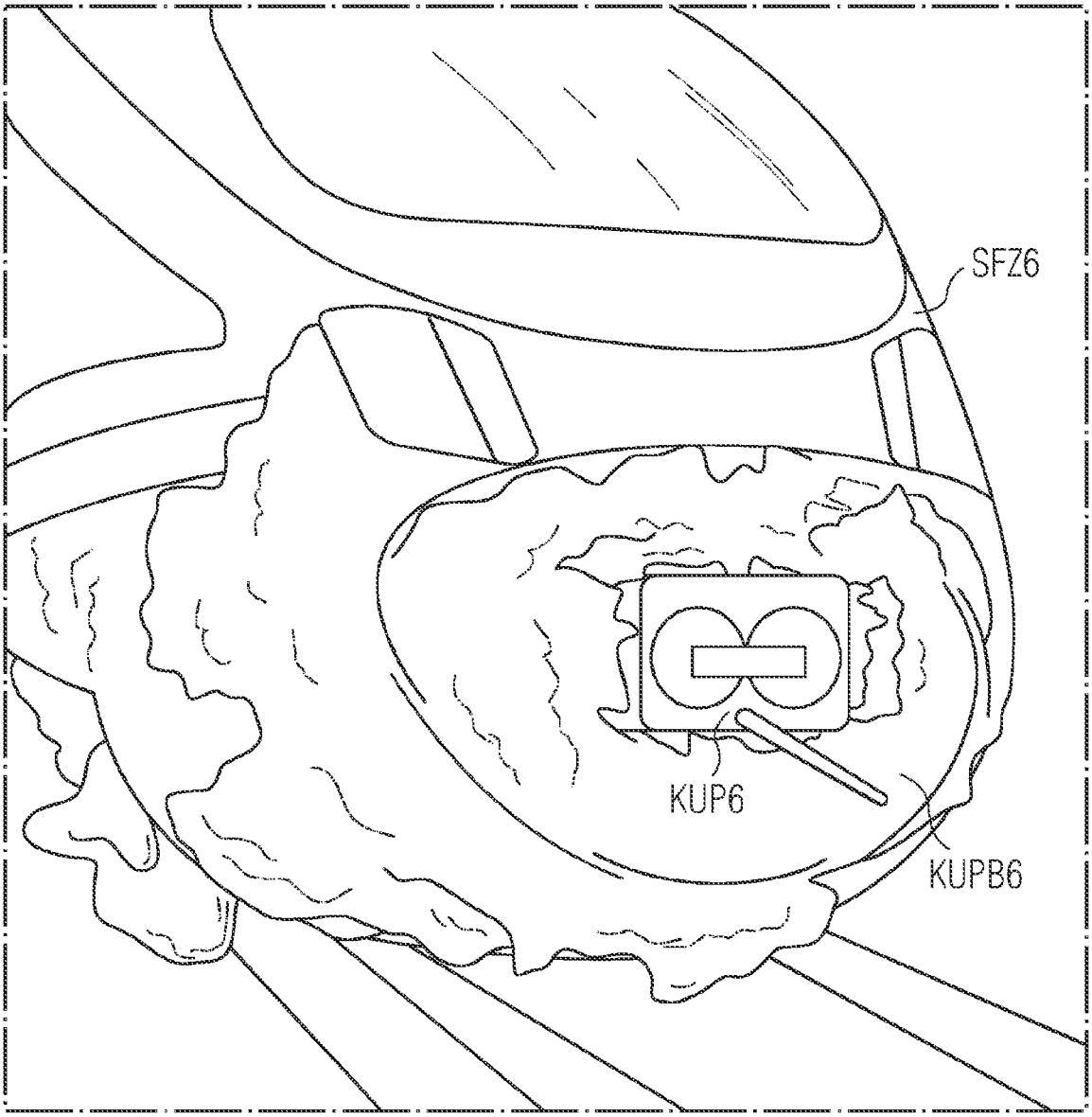
FIGS. 5 to 11 show the embodiments of known snow protection arrangements already described in the introduction.
Figure 6:
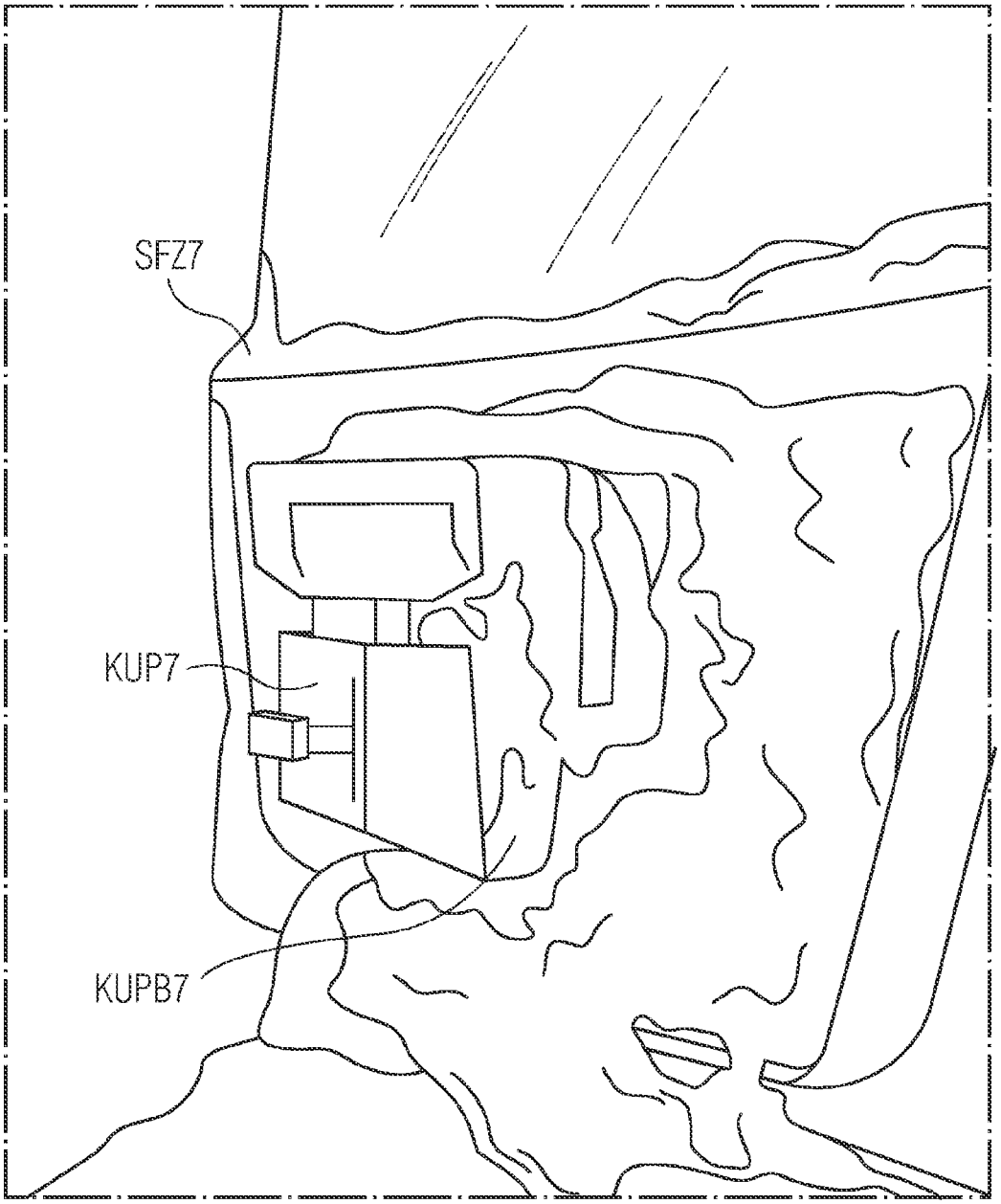
Figure 7:
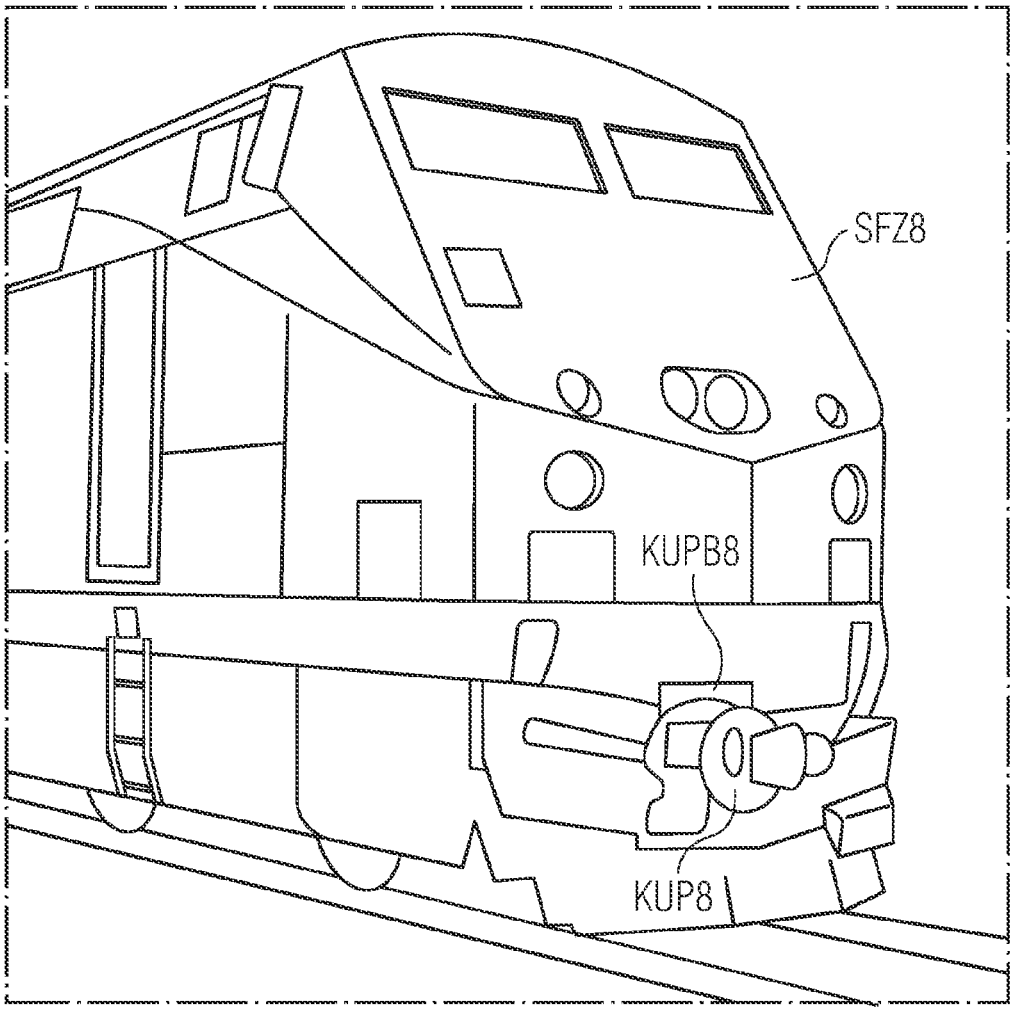
Figure 8:
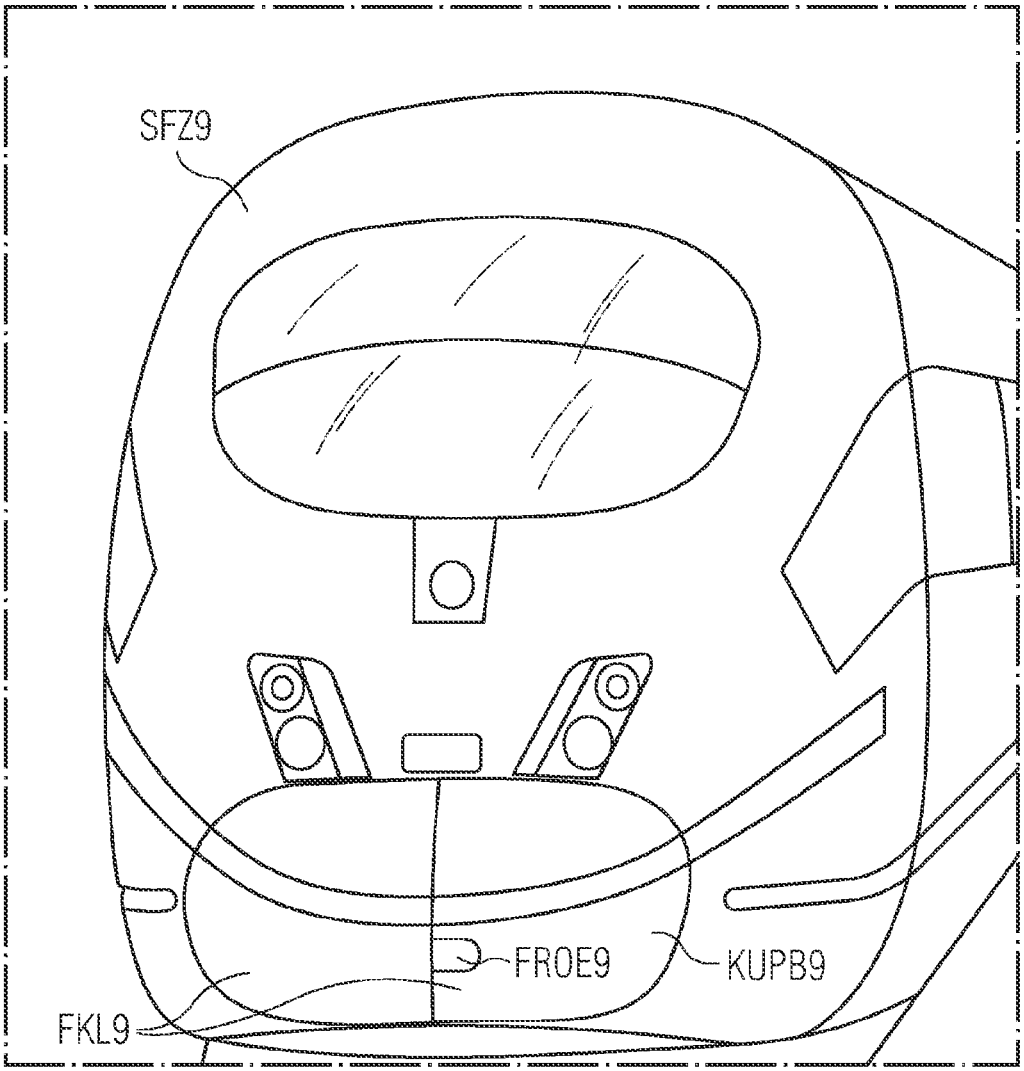
Figure 9:
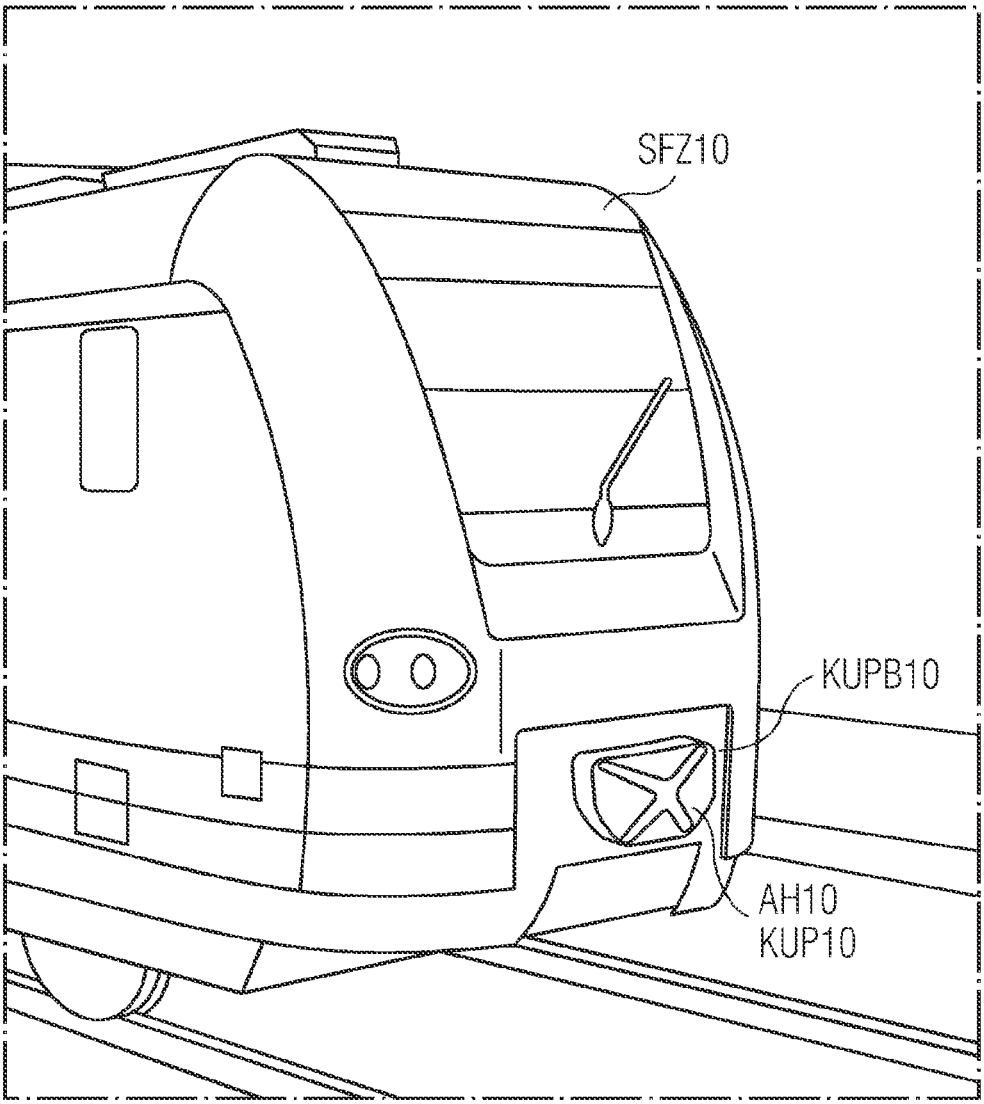

FIG. 4 shows with reference to FIG. 1 to FIG. 3 an advantageous development of the arrangement according to the invention.

This embodiment addresses the case that two rail vehicles which are located with respect to each other on a tight curved track are coupled to each other.

In order to carry out the coupling operation, operators would have to displace the two sealing elements DIE1, DIE2 by means of the application of force. If the two sealing elements DIE1, DIE2 are, for example, produced from rubber, it could be the case that the required force cannot be applied by the operators.

In order to solve this problem, the swivel joint DRG is displaceably supported along the longitudinal axis of the coupling KUP.

A pressure or tension spring FED fixes the swivel joint DRG in position and limits the pressure or pressing force of the two sealing elements DIE1, DIE2.

The two sealing elements DIE1, DIE2 are coupled to each other in particular in the deflected state of the second sealing element DIE2.

The invention claimed is:

1. A snow protection configuration for a coupling region of a rail vehicle, the rail vehicle having at a front side a recess formed therein which is intended to be protected from the snow and in which a coupling of the rail vehicle is at least partially disposed, the snow protection configuration comprising:

a fixed housing at least partially surrounding the recess, said fixed housing having in a travel direction of the rail vehicle an opening formed therein from which the coupling partially protrudes in a predetermined angular position in order to enable a coupling operation with an additional rail vehicle, a first sealing element, said opening of said fixed housing is peripherally defined by said first sealing element;

a second sealing element being rotatably connected to the coupling and wherein the second sealing element at least partially surrounding the coupling; and said first and second sealing elements at least partially overlap each other in a region of the opening in different angular positions of the coupling, said first and second sealing elements are coupled to each other by means of pressure in order to protect said opening from penetration by the snow.

2. The configuration according to claim 1, wherein at least one of said first and second sealing elements is configured in a flexible manner.

3. The configuration according to claim 1, wherein said first sealing element is configured as a flexible hollow chamber profile or as a flexible bead.

4. The configuration according to claim 3, wherein at least one of said first sealing element or said second sealing element is produced from a flexible rubber.

5. The configuration according to claim 3, wherein said flexible hollow chamber profiles or said flexible beads are constructed in such a manner that translational movements of coupled rail vehicles are received in a direction of a longitudinal axis of the coupled rail vehicles by said flexible hollow chamber profiles or said flexible beads being pressed in with simultaneous sealing.

6. The configuration according to claim 3, wherein said flexible hollow chamber profiles or said flexible beads are constructed in such a manner that, during lateral movements of coupled rail vehicles transversely relative to a longitudinal axis, said flexible hollow chamber profiles or said flexible beads slide on each other and consequently absorb these movements with simultaneous sealing.

7. The configuration according to claim 3, wherein said flexible hollow chamber profiles or said flexible beads are constructed in such a manner that, during angular movements of coupled rail vehicles with respect to each other, said flexible hollow chamber profiles or said flexible beads are pressed in to differing degrees in order to absorb relative movements which occur with simultaneous sealing.

8. The configuration according to claim 1, wherein said second sealing element is configured as a flexible hollow chamber profile or as a flexible bead.

9. The configuration according to claim 1, further comprising a swivel joint, said second sealing element is connected to the coupling by means of said swivel joint.

10. The configuration according to claim 1, wherein said second sealing element has flexible sleeves which are disposed in a region around the coupling and which additionally seal a transition to the coupling.

11. The configuration according to claim 10, wherein said flexible sleeves are produced from rubber.

12. The configuration according to claim 1, wherein the coupling is constructed in such a manner that the rail vehicle can be connected via the coupling to a correspondingly configured coupling of the additional rail vehicle.

13. The configuration according to claim 1, wherein the coupling is movably supported inside said recess so that, for purposes of the coupling operation with the additional rail vehicle, the coupling can be horizontally and vertically pivoted in a predetermined angular range.

* * * * *